US005621376A

United States Patent [19]

Takeda

[11] Patent Number: 5,621,376

[45] Date of Patent: Apr. 15, 1997

[54] THERMOSTAT WITH A FOLDED FIXING MEMBER

[75] Inventor: Hideaki Takeda, Misato, Japan

[73] Assignee: Uchiya Thermostat Co., Misato, Japan

[21] Appl. No.: 565,670

[22] Filed: Dec. 1, 1995

[30] Foreign Application Priority Data

Dec. 9, 1994 [JP] Japan ..... 6-305810

[51] Int. Cl.[6] ..... H01H 37/04; H01H 37/52; H01H 11/00

[52] U.S. Cl. ..... 337/372; 337/380; 29/622

[58] Field of Search ..... 29/623, 622; 337/372, 337/380, 365, 343

[56] References Cited

U.S. PATENT DOCUMENTS 4,278,960 7/1981 Muller ..... 337/365
4,755,787 7/1988 Wehl ..... 337/372
4,978,937 12/1990 Givier ..... 337/372
5,014,034 5/1991 Wehl ..... 337/368
5,014,035 5/1991 Hamada ..... 337/372

*Primary Examiner*—Leo P. Picard
*Assistant Examiner*—Stephen T. Ryan
*Attorney, Agent, or Firm*—Fish & Richardson, P.C.

[57] ABSTRACT

The purpose of the invention is to make it possible to adjust the heating rate inside the thermostat independently from the characteristics of the resilient plate in a thermostat, and to reduce the contamination inside the thermostat caused by particles.

A fixing member is fabricated by folding a sheet of metal with at least a couple of holes having different diameters, so that the holes are aligned to each other, and the fixing member is configured so that the larger diameter part of the hole is far from the bimetal, the fixing member is penetrated by protrusions in the fixed plate, and the top of the protrusion is melted to spread in the larger diameter part.

3 Claims, 4 Drawing Sheets

THERMOSTAT WITH A FOLDED FIXING MEMBER

FIELD OF THE INVENTION AND RELATED ART STATEMENT

The present invention relates to a thermostat including a fixed plate on which a static contact point is mounted, a resilient plate on which a movable contact point is mounted, and a bimetal plate which is so deformed, when the temperature of said bimetal plate exceeds a predetermined temperature, to deform said resilient plate so that said movable contact point is separated from said static contact point.

FIG. 9 shows a cross-section of a thermostat of prior art.

The electric current flows through a circuit including a lead line 1, a resilient plate 2, a movable contact point 3 mounted on the resilient plate, a stable contact point 4, a fixed plate 5 on which said stable contact point in mounted, and another lead line 6.

When the temperature of the bimetal plate 7 exceeds a predetermined temperature, the curvature of the bimetal plate turns over. As a result, the resilient plate 2 is so deformed that the movable contact point 3 separates from the stable contact point 4 to cut off the electric current.

Such a thermostat can be fabricated by following steps.

A fixed plate 5 shown in FIG. 10 is embedded in a conjunction member 8 made of artificial resin. This conjunction member 8 has two protrusions 10.

The two protrusions 10 penetrate through two holes 2*a* of the resilient plate 2 shown in FIG. 11, two holes 7*a* of the bimetal plate 7 shown in FIG. 12 and two holes of a fixing member 12 of artificial resin. The tops of the protrusions 10 are melted to fix the resilient plate 2, the bimetal plate 7 and the fixing member 12 to the conjunction member 8.

After being connected necessary lead lines 1, 6, the assembly fixed to the conjunction member 8 is inserted in a housing 13, the opening of the housing is filled with sealing resin 14.

By users, various characteristics are demanded to a thermostat. It is preferable, for example, that the inner electric resistivity shall be changeable so as to adjust the heating rate at the inside of a thermostat. In prior art, this requirement is answered by selecting the material or dimensions of the resilient plate.

OBJECT AND SUMMARY OF THE INVENTION

The resilient plate shall have a proper electric conductivity and a proper elasticity as a principal characteristics of a thermostat, thus it is difficult to impose another condition to the resilient plate, for adjusting the heating rate.

Another problem of thermostat of prior art is caused by an artificial resin fixing member 12; because of static electricity, a fixing member 12 tends to attract small particles, and they can be brought into the housing with it. These small particles causes sometimes insulation trouble.

An object of the present invention is to propose a thermostat capable to adjust the inner electric resistivity, and is made using small quantity of artificial resin.

The problem of the invention is solved by a thermostat including two terminals to be connected with an external circuit, a fixed plate connected with one of said terminals and on which a static contact point is mounted, a resilient plate connected with the other of said two terminals directly or indirectly and on which a movable contact point is mounted correspondingly to the static contact point, a bimetal plate engaging with the resilient plate at its one end, a conjunction member having protrusions and a fixing member; whereby said fixed plate is embedded in the conjunction member; the resilient plate, the bimetal plate and the fixing member have holes; the protrusions of the conjunction penetrate through the holes of the resilient plate, bimetal plate and the fixing plate; the tops of the protrusions are melted to fix the fixing member, the bimetal plate and the resilient plate to the conjunction member; when the temperature of the bimetal plate exceeds a predetermined temperature, the curvature of the bimetal plate turns over, and the resilient plate so deforms that the movable contact point separates from the stable contact point; characterized in that, the fixing member is made by folding a metal plate having two couples of holes with different diameter, so that each couple of holes align one over another; and the fixing members is so oriented that the smaller diameter hole sides faces to the bimetal plate.

In a preferred embodiment of the present invention, a part of the fixing member is elongated to form a first terminal, and the fixing member and the bimetal plate are welded to each other at a position near to the first terminal.

In another preferred embodiment of the present invention, a part of the fixing member is elongated to form a first terminal; the fixing member and the bimetal plate are welded to each other at a position near to the first terminal; the electric current flows through the first terminal, the fixing member, the bimetal plate, the resilient plate, and the fixed plate; and the heating rate at the inside of the thermostat can be adjusted by selecting the material of the fixing member and by adjusting the dimensions of the fixing member.

The following advantages can be obtained by the present invention.

(1) As the material of the fixing member is metal, no static electricity appears, and the quantity of small particles brought in the thermostat is small.

(2) A couple of holes including two parts having different inner diameter can be easily fabricated, by folding a sheet of a metal plate.

(3) As the fixing member and a terminal can be made using one material, the characteristics of the thermostat can be adjusted independently from the characteristics of the resilient plate; the heating rate at the inside of the thermostat, for example, can be adjusted, by selecting the material of the fixing member and by adjusting the dimensions of the fixing member. In other words, the freedom of designing is high, because the resilient plate 5 is not used for adjusting the heating rate.

DETAILED DESCRIPTION OF PREFERRED EMBODIMENTS

Figure 1:
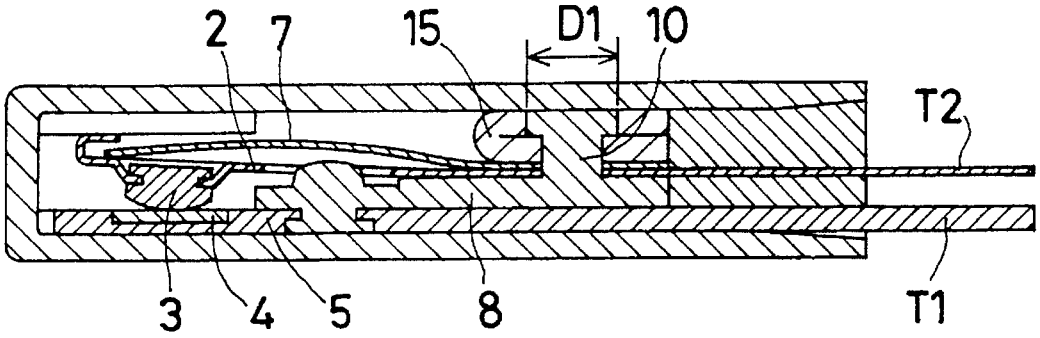
FIG. 1 shows a cross-section of an embodiment of a thermostat according to the present invention.

Preferred embodiments of the present invention are shown below. The elements common to prior art are given the corresponding reference numerals, and their explanations are abbreviated.

FIG. 1, 2, 3 show a first embodiment of the present invention. A fixing member 15 is formed by folding a sheet of metal plate 15 so that its two holes 14*a*, 14*b* having different diameter D1, D2 align to each other.

The form of the holes are not restricted to a circle but other forms, for example, rectangular are permissible. In such a case, the wording "diameter" in the claims shall be read as "greatness".

A second terminal T2 is formed at an elongated part of the resilient plate 2. A bimetal plate 7 is disposed on the resilient plate 2, and a fixing member 15 is disposed on the bimetal plate 7 in turn. The fixing member 15 is so arranged that the part having greater diameter D1 is far from the bimetal plate 7 and the part having smaller diameter faces to the bimetal plate 7.

Figure 3:
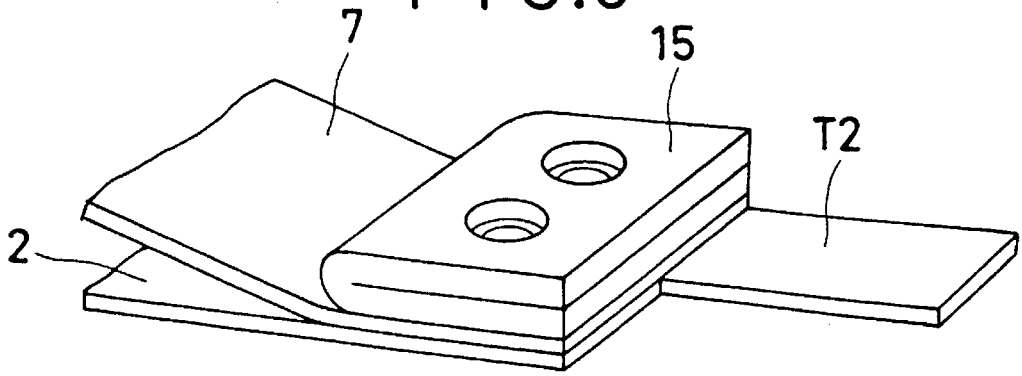
FIG. 3 shows a perspective view of an arrangement of a resilient plate and a bimetal plate of thermostat of FIG. 3.

The protrusions 10 of the conjunction member 8 penetrate through a (not shown) hole of the resilient plate 2, a (not shown) hole of the bimetal plate, and a hole of the fixing member 15 shown in FIG. 3.

In the fabrication process, when the top of the protrusions is heated to melt, the melting top of the protrusions spreads in the greater diameter portion of the holes. They solidify as they were.

As the fixing member is metal, less small particles are attracted by static electricity of the fixing member.

Figure 2:
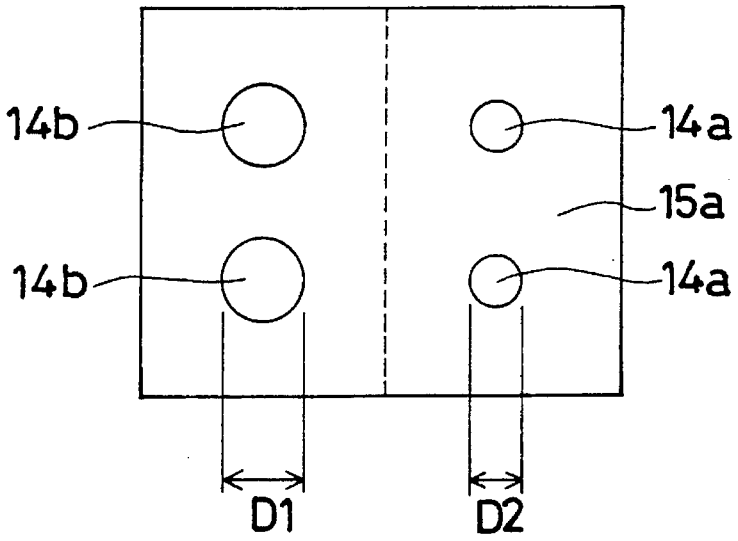
FIG. 2 shows a front view of a metal plate for a fixing member of the thermostat of FIG. 1.
Figure 4A:
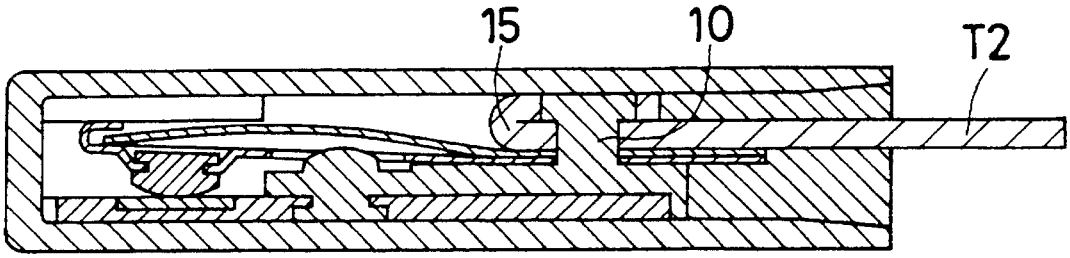
FIG. 4 shows another embodiment of a thermostat according to the present invention. (A) is a cross-section passing through A—A and a stable contact point. (B) is a cross-section passing through B—B.
Figure 4B:
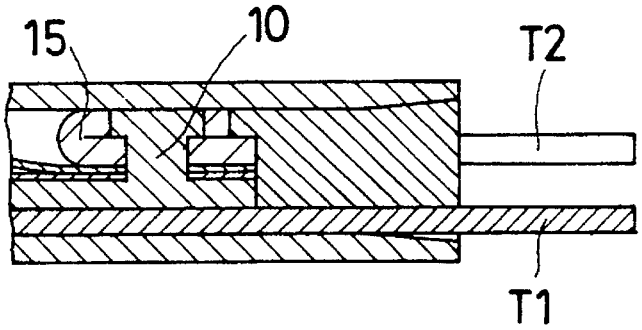
Figure 5:
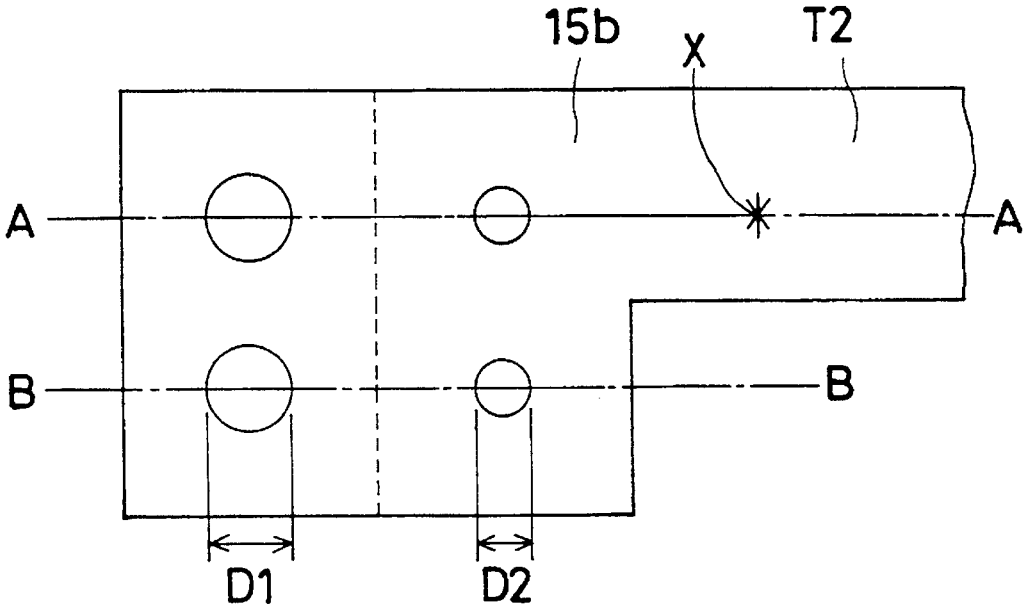
FIG. 5 shows a front view of a metal plate for a fixing member of the thermostat of FIG. 4.
Figure 6:
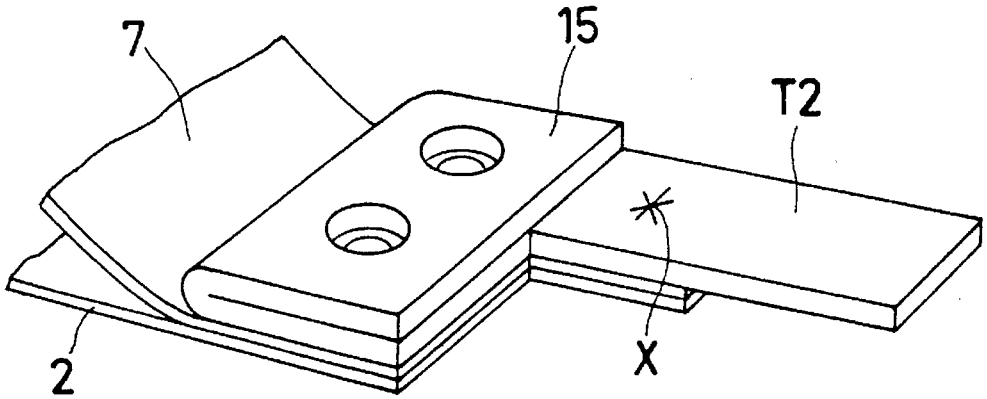
FIG. 6 shows a perspective view of an arrangement of a resilient plate and a bimetal plate of FIG. 4.

FIGS. 4, 5, 6 show a second embodiment of the present invention. The fixing member 15 is fabricated by folding a sheet of metal 15 shown in FIG. 5. The sheet of metal 15*b* in FIG. 5 is different from the sheet of metal 15*a* in FIG. 2 in the second terminal T2.

The resilient plate 2, the bimetal plate 7 and the fixing member 15 are arranged as shown in FIG. 6. The fixing member 15 is so arranged that the greater diameter part (D1) of the holes of the fixing member 15 is far from the bimetal plate 7. The protrusions 10 of the conjunction member 8 penetrate through the holes of the resilient plate 2, bimetal plate 7 and the fixing member 15. The melted top of the protrusions 10 spreads in the greater diameter parts of the holes of the fixing member 15, so as to fix to each other these members and plates.

In this embodiment, the fixing member 15, the bimetal plate 7 and the resilient plate 2 are welded to each other at a position X near to the second terminal T2.

The heating rate at the inside of the thermostat can be adjusted by selecting the material of the fixing member 15 and adjusting its dimensions.

Figure 7:
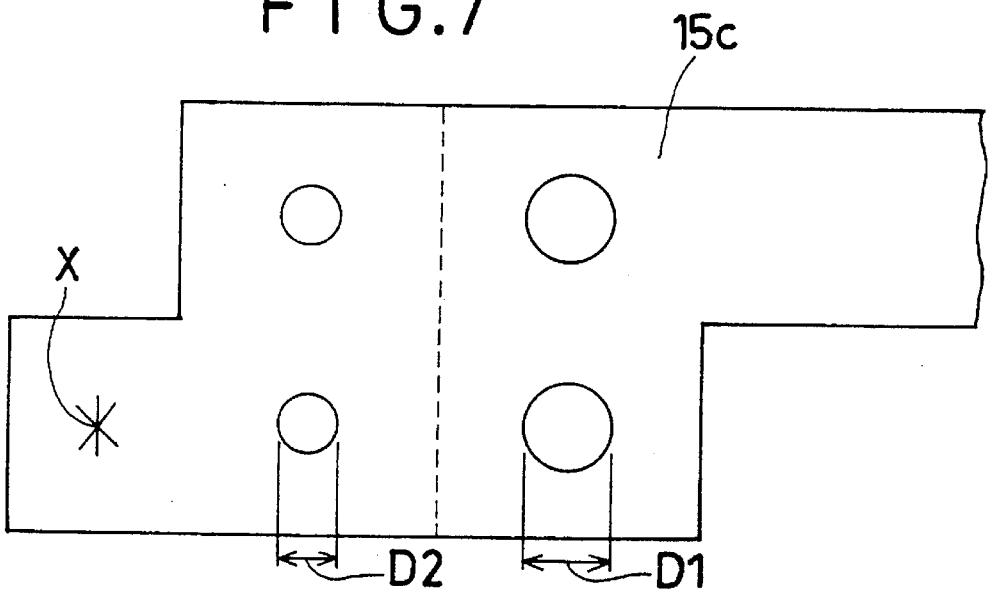
FIG. 7 shows a front view of a metal plate for a fixing member of a thermostat of third embodiment of the present invention.
Figure 8:
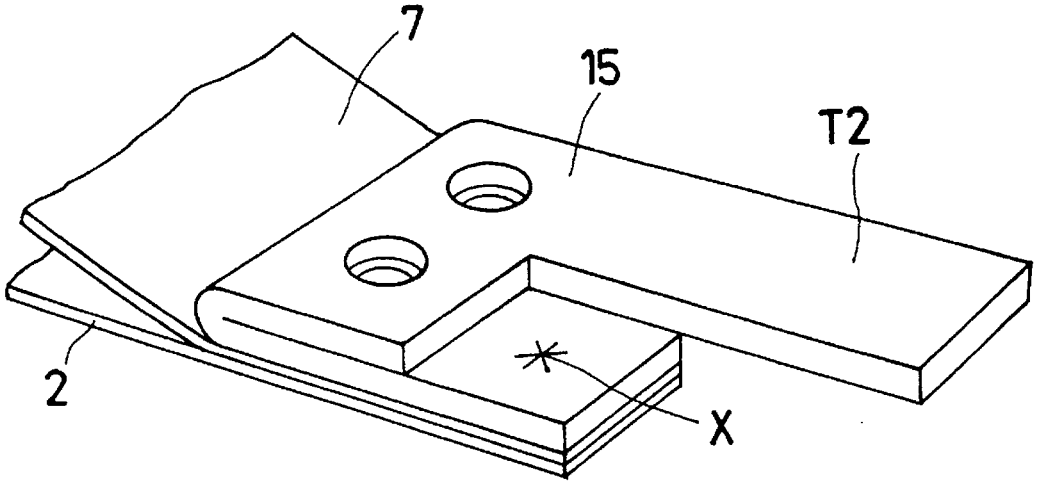
FIG. 8 shows a perspective view of an arrangement of a resilient plate and a bimetal plate of a thermostat of FIG. 7.
Figure 9:
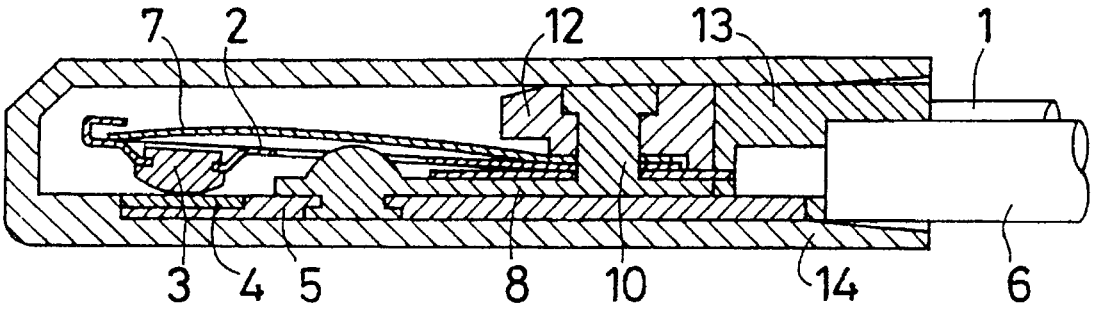
FIG.9 (PRIOR ART)
FIG. 9 shows an example of thermostat of prior art.
Figure 10:
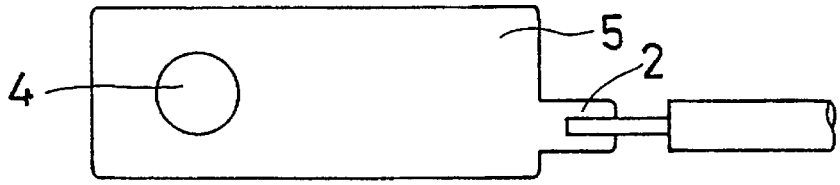
FIG.10 (PRIOR ART)
FIG. 10 shows a front view of the fixed plate of the thermostat of FIG. 9.
Figure 11:
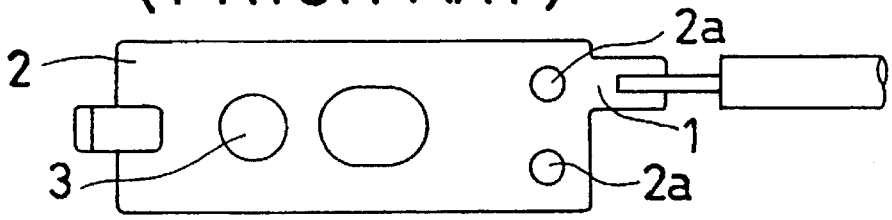
FIG.11 (PRIOR ART)
FIG. 11 shows a front view of the resilient plate of the thermostat of FIG.
Figure 12:
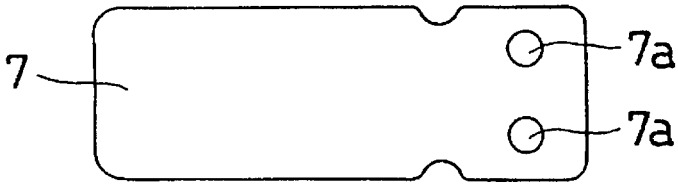
FIG.12 (PRIOR ART)
FIG. 12 shows a front view of the bimetal plate of the thermostat of FIG. 9.

FIGS. 7, 8 show a third embodiment of the present invention. The fixing member 15 can be fabricated by folding a sheet of metal 15*c* shown in FIG. 7.

The sheet of metal 15*c* in FIG. 7 is different from the sheet of metal 15*b* in the elongated portion for spot welding.

In the same manners shown in the first and second embodiments, the fixing member 15, the bimetal plate 7, the resilient plate 2 are arranged and fixed by the protrusion 10 of the conjunction members 10.

In this embodiment, the fixing member 15, the bimetal plate 7 and the resilient plate 2 are spot welded to each other at a position X in the elongated portion.

The electric current flows through a circuit including the second terminal T2, the fixing member 15, the bimetal plate 7, the resilient plate 2, the movable contact point 3, the stable plate 5 and the first terminal T1. By making greater the dimensions of the fixing member 5, the heating rate can be increased, and it is easy to adjust it.

Many metals, for example, brass, white silver, irons, stainless steel, nichrome, can be used for fabricating the fixing member, because restriction for the machinery is small.

(1) As the fixing member is metal, attraction by static electricity of a small particles does not occur. And it can be prevented to bringing the particles into the inside of the thermostat.

(2) In a conventional art, it was difficult to make a great resistivity in a small volume of a resilient plate. According to the present invention, the current flows from one end to the other end of the folded fixing member, heat can be effectively generated at the fixing member. Thus the disadvantage of prior art, the resilient plate having greater electric resistivity tends to overheat at an over current, can be eliminated.

(3) It is possible to fabricate holes including two parts having different diameter with easy machining method. Thus almost any metal can be used for fixing member, and the machining cost can be made small.

(4) By selecting the material, the characteristics can be adjusted by the fixing member as well as by the resilient plate.

I claim:

1. A thermostat including two terminals to be connected with an external circuit, a fixed plate connected with one of said terminals and on which a static contact point is mounted, a resilient plate connected with the other of said two terminals directly or indirectly and on which a movable contact point is mounted correspondingly to the static contact point, a bimetal plate engaging with the resilient plate at its one end, a conjunction member having protrusions and a fixing member; whereby said fixed plate is embedded in the conjunction member; the resilient plate, the bimetal plate and the fixing member have holes; the protrusions of the conjunction penetrates through the holes of the resilient plate, bimetal plate and the fixing plate; the tops of the protrusions are melted to fix the fixing member, the bimetal plate and the resilient plate to the conjunction member; when the temperature of the bimetal plate exceeds a predetermined temperature, the curvature or the bimetal plate turns over and the resilient plate so deforms that the movable contact point separates from the stable contact point; characterized in that, the fixing member is made by folding a metal plate having two couple of holes with different diameter, so that each couple of holes align one over another; and the fixing member is so oriented that the smaller diameter hole sides faces to the bimetal plate.

2. A thermostat according to the claim 1 characterized in that a part of the fixing member is elongated to form a first terminal; and the fixing member, the bimetal plate and the resilient plate are spot welded to each other at a position near to the first terminal.

3. A thermostat according to the claim 1 characterized in that the fixing member, the bimetal plate and the resilient plate are spot welded to each other at a position far from the first terminal; the electric current flows through the first terminal, the fixing member, the bimetal plate, the resilient plate and the fixed plate; the characteristics of the thermostat, for example heating rate at the inside of the thermostat, can be adjusted by selecting the material of the fixing member and by adjusting the dimensions of the fixing member.

* * * * *